US009592668B2

(12) United States Patent
Kuroda et al.

(10) Patent No.: US 9,592,668 B2
(45) Date of Patent: Mar. 14, 2017

(54) LIQUID EJECTION HEAD AND LIQUID EJECTION APPARATUS

(71) Applicant: CANON KABUSHIKI KAISHA, Tokyo (JP)

(72) Inventors: Tomotsugu Kuroda, Yokohama (JP); Kiyomitsu Kudo, Machida (JP); Satoshi Kimura, Kawasaki (JP); Kyosuke Toda, Kawasaki (JP); Naoko Tsujiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/823,465

(22) Filed: Aug. 11, 2015

(65) Prior Publication Data

US 2016/0052268 A1 Feb. 25, 2016

(30) Foreign Application Priority Data

Aug. 25, 2014 (JP) ..... 2014-170348

(51) Int. Cl.
*B41J 2/14* (2006.01)
*B41J 2/175* (2006.01)
*B41J 29/02* (2006.01)

(52) U.S. Cl.
CPC ..... *B41J 2/1433* (2013.01); *B41J 2/1752* (2013.01); *B41J 2/1753* (2013.01);
(Continued)

(58) Field of Classification Search
CPC .. B41J 2/1752; B41J 2/17553; B41J 2/17509; B41J 2/17523; B41J 2/175; B41J 2/17503; B41J 2002/14491; B41J 2/1433
(Continued)

(56) References Cited

U.S. PATENT DOCUMENTS 6,536,870 B1 3/2003 Takahashi et al.
6,824,243 B2 11/2004 Yamaguchi et al.
(Continued)

FOREIGN PATENT DOCUMENTS

JP 2003-237083 A 8/2003
JP 2004-130667 A 4/2004
JP 2012-066581 A 4/2012

OTHER PUBLICATIONS

Tomotosugu Kuroda, Kiyomitsu Kudo, Yuichiro Akama, Satoshi Kimura, Kyosuke Toda, Naoko Tsujiuchi, Sayaka Seki, Yosuke Takagi, U.S. Appl. No. 14/719,625, filed May 22, 2015.
(Continued)

*Primary Examiner* — Jannelle M Lebron
(74) *Attorney, Agent, or Firm* — Fitzpatrick, Cella, Harper & Scinto

(57) ABSTRACT

A liquid ejection head includes: an element-substrate to eject liquid according to an electrical signal; an electrical circuit substrate to send the electrical signal; and a body including the element-substrate on a first face and the electrical circuit substrate on a second face, in which the liquid ejection head is mounted in a mount unit of a liquid ejection apparatus via an electrical connector; the body includes a pressure-receiving portion for receiving a force including components in first and second directions; the liquid ejection head includes first and second positioning portions that determine a position of the body; and the first positioning portion is arranged at both outsides of an arrangement region of the element substrate; the second positioning portion is arranged at both sides of the second face; and the pressure-receiving portion is arranged at the both sides and an intermediate portion of the body.

11 Claims, 9 Drawing Sheets

(52) U.S. Cl.
CPC ..... *B41J 2/17523* (2013.01); *B41J 29/02* (2013.01); *B41J 2002/14491* (2013.01)

(58) Field of Classification Search
USPC ..... 347/20, 50, 84, 85, 86
See application file for complete search history.

(56) References Cited

U.S. PATENT DOCUMENTS

| | | | | |
|---|---|---|---|---|
| 8,944,558 | B2 | 2/2015 | Kudo et al. | |
| 2012/0050385 | A1* | 3/2012 | Kudo | B41J 2/14024 347/20 |
| 2013/0070022 | A1 | 3/2013 | Ogawa et al. | |

OTHER PUBLICATIONS

Sayaka Seki, Kiyomitsu Kudo, Yuichiro Akama, Satoshi Kimura, Tomotsugu Kuroda, Kyosuke Toda, Naoko Tsujiuchi, Yosuke Takagi, U.S. Appl. No. 14/719,609, filed May 22, 2015.
Yuichiro Akama, Kiyomitsu Kudo, Satoshi Kimura, Tomotsugu Kuroda, Kyosuke Toda, Naoko Tsujiuchi, Sayaka Seki, Yosuke Takagi, U.S. Appl. No. 14/719,614, filed May 22, 2015.
Office Action dated Sep. 29, 2016, in Chinese Patent Application No. 201510527335.3.

* cited by examiner

LIQUID EJECTION HEAD AND LIQUID EJECTION APPARATUS

BACKGROUND OF THE INVENTION

Field of the Invention

The present invention relates to a liquid ejection head ejecting liquid and a liquid ejection apparatus.

Description of the Related Art

The liquid ejection head has been positioned with respect to a guide shaft of a liquid ejection apparatus via a carriage that is a mount unit. The liquid ejection head mounted to the carriage ejects liquid such as ink onto a medium such as paper while scanning in a direction of the guide shaft. The ejected liquid lands on the medium to form an image thereon. At this point, the liquid ejection head ejects the liquid on the assumption that an alignment direction of ejection openings for ejecting the liquid is correctly, vertically arranged with respect to a scanning direction of the liquid ejection head. Therefore, the liquid ejection head needs to be accurately positioned with respect to the carriage so that the alignment direction of the ejection openings is correctly, vertically arranged to the scanning direction.

A variety of configurations are known as a configuration for positioning the liquid ejection head with respect to the carriage. For example, Japanese Patent Laid-Open No. 2012-66581 discloses a configuration for performing positioning in which both sides of the body of the liquid ejection head or the both sides and a central portion thereof are pressed with a spring to make one point of the central portion of a backside of the body and two points of a support substrate, in other words, three points in total abut on the carriage so as to perform the positioning.

SUMMARY OF THE INVENTION

A body of a liquid ejection head includes an electrical circuit substrate to electrically connect with a main body of a liquid ejection apparatus. The more the number of electrical contact points for performing electrical connection increases, the wider a region where the electrical contact points are arranged is widened in the body of the liquid ejection head. According to the configuration of positioning disclosed in Japanese Patent Laid-Open No. 2012-66581, in a case where the electrical contact points are arranged more upward than positioning points in a posture of usage, it is found difficult to realize both highly-accurate positioning of the liquid ejection head and securing reliability of electrical contact.

The present invention has been made in view of the above-described circumstances. An issue of the present invention is to realize highly-accurate positioning of the liquid ejection head with respect to the liquid ejection apparatus at any arrangement of the electrical contact points, and securing the reliability of the electrical contact.

To solve the above-described problems, the liquid ejection head of the present invention includes:

an element substrate configured to eject liquid according to an electrical signal;

an electrical circuit substrate configured to send the electrical signal to the element substrate; and a body including the element substrate on a first face and the electrical circuit substrate on a second face crossing the first face, in which the liquid ejection head is mounted in a mount unit of a liquid ejection apparatus via an electrical connector including an electrical contact point with the electrical circuit substrate; in which the body includes a pressure-receiving portion for, in a case where the body is mounted in the mount unit, receiving a force including a component in a first direction in which the second face is pressed against the mount unit and a component in a second direction in which the element substrate ejects liquid; in which the liquid ejection head includes a first positioning portion provided on the first face and a second positioning portion provided on the second face, that determine a position of the body with respect to the mount unit in the first direction by abutting on the mount unit; and in which the first positioning portion is arranged at both outsides of an arrangement region of the element substrate in a direction along an intersection line between the first face and the second face; in which the second positioning portion is arranged at both sides of the second face in a direction along the intersection line; and in which the pressure-receiving portion is arranged at the both sides of the body and at an intermediate portion between the both sides in the direction along the intersection line.

According to the present invention, highly-accurate positioning of the liquid ejection head with respect to the liquid ejection apparatus at any arrangement of the electrical contact points, and securing the reliability of the electrical contact can be realized. According to the present invention, further, a favorable mounting property of the liquid housing container to the liquid ejection head can be realized.

Further features of the present invention will become apparent from the following description of exemplary embodiments (with reference to the attached drawings).

DESCRIPTION OF THE EMBODIMENTS

Figure 1:
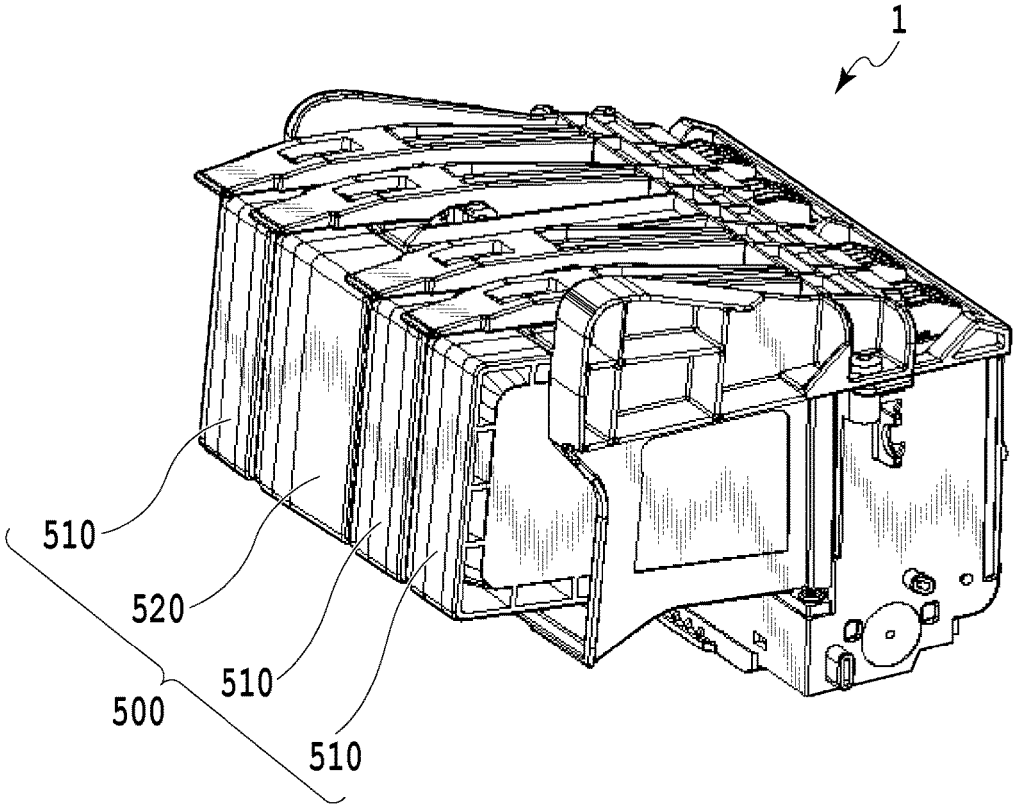
FIG. 1 is a perspective view of a head with a tank mounted according to the present invention.

With reference to drawings, embodiments of the present embodiment will be described below. In the drawings, same configuration elements are indicated using a same reference symbol, and the description will not be repeated.

(Liquid Ejection Apparatus)

Figure 5A:
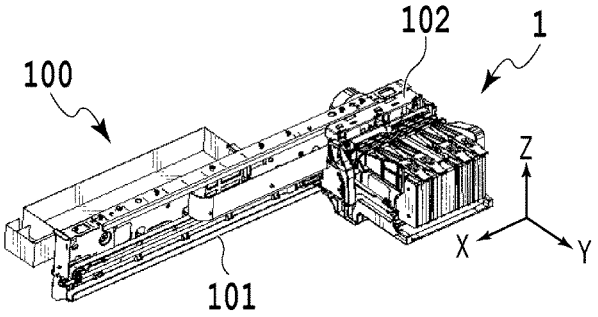
FIGS. 5A to 5D illustrate a liquid ejection apparatus, the head, and a carriage according to the present invention.

FIG. 5A is a schematic perspective view of a liquid ejection apparatus 100 according to an embodiment of the present invention.

The liquid ejection apparatus 100 includes a guide rail 101, a carriage 102 scanning in a scan direction along a direction (hereinafter, also simply referred to as "X direction") indicated with an arrow X in FIG. 5A along the guide rail 101. The carriage 102 is mounted with a liquid ejection head 1 according to the embodiment of the present invention. The liquid ejection apparatus 100 ejects liquid such as ink in a direction (−Z direction) opposite to an orientation of an arrow Z (Z direction) indicated with the arrow Z from the liquid ejection head 1 while causing the carriage 102 to scan along the X direction, so as to apply the liquid to a medium facing the liquid ejection head 1. The medium is conveyed by a conveyance unit (not illustrated) in a conveyance direction (hereinafter, also simply referred to as "Y direction") indicated with the arrow Y in FIG. 5A. The liquid is appropriately applied and the medium is appropriately conveyed to form an image on the medium.

(Liquid Ejection Head)

FIG. 1 is a perspective view illustrating the liquid ejection head 1 according to the embodiment of the present invention. The liquid ejection head (hereinafter, also simply referred to "head") 1 is removably mounted with a liquid housing container (hereinafter, also simply referred as "tank") 500 for storing the liquid. According to the embodiment, totally four tanks 500 are mounted, more specifically, three first tanks 510 having a frame body in a substantially same size and one second tank 520 having a frame body that is larger in width than that of the first tank are mounted. According to the embodiment, each tank 500 is filled with ink having different colors as the liquid.

Figure 2A:
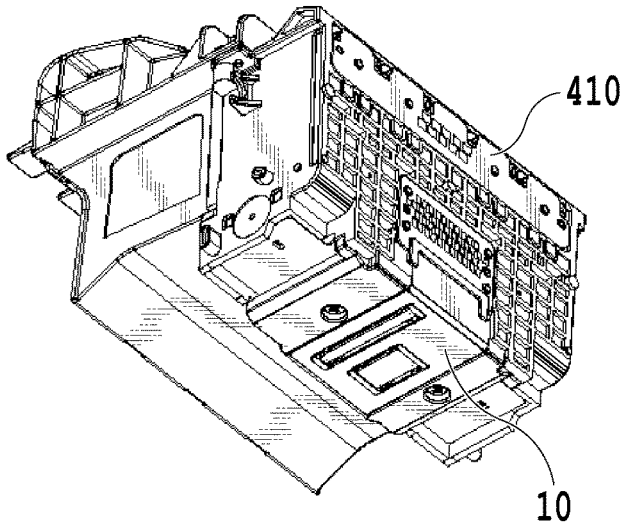
FIGS. 2A to 2C are perspective views illustrating the head according to the present invention.
Figure 2B:
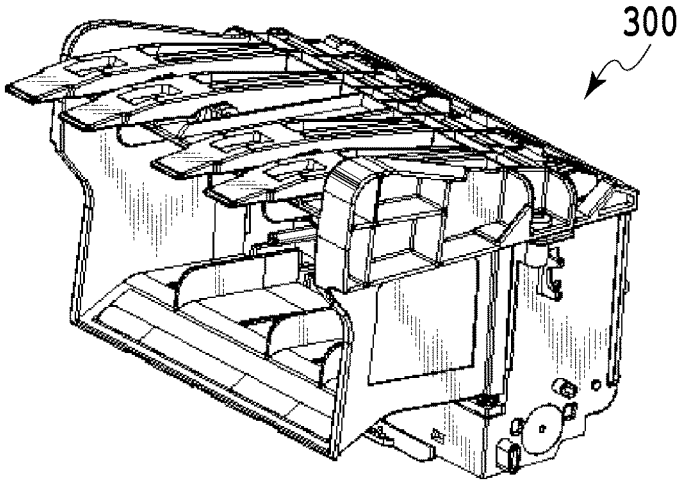
Figure 2C:
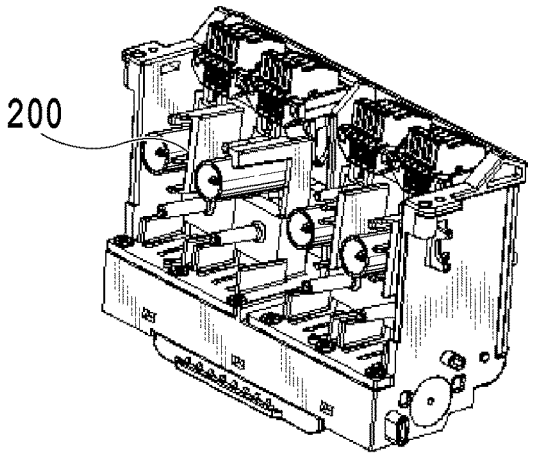

FIGS. 2A to 2C are perspective views illustrating the head 1 without the tank 500 mounted. The head 1 includes a liquid supply unit 10, a tank fixing unit 300, and a tank connection unit 200. The tank fixing unit 300 performs positioning of the tank 500 to be mounted to the head 1. The tank connection unit 200 supplies the liquid in the tank 500 mounted to the head 1 into the head 1. The liquid supply unit guides and ejects the liquid supplied from the tank connection unit 200 to the element substrate. With reference to FIGS. 3A, 3B and FIGS. 4A to 4G, each unit will be described in detail below.

(Liquid Supply Unit)

Figure 3A:
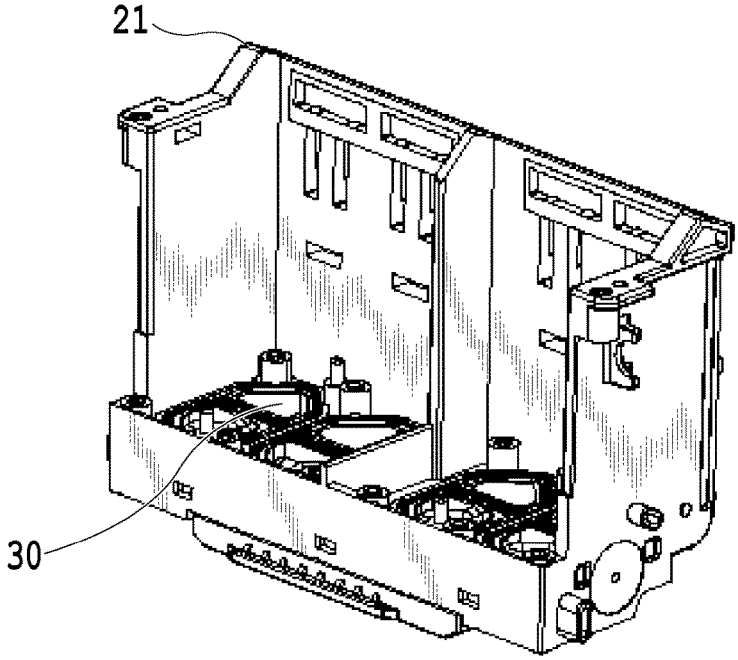
FIGS. 3A and 3B are perspective views illustrating a liquid supply unit of the head according to the present invention.
Figure 3B:
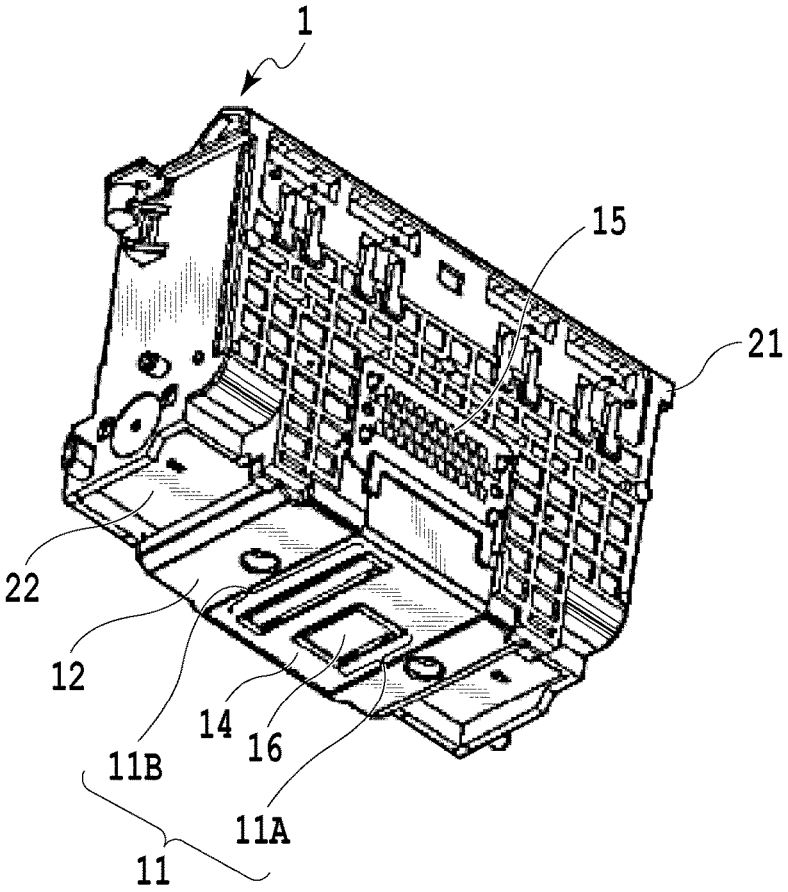

With reference to FIGS. 3A, 3B, the liquid supply unit 10 will be described.

The liquid supply unit 10 includes two element substrates 11A, 11B as an element substrate 11 ejecting the liquid, a support substrate 12, an electrical wiring member 14, a first electrical circuit substrate 15, a body 21, a flow-path forming member 22, a joint member (not illustrated), and a filter 30.

The element substrate 11A and the element substrate 11B are provided on the support substrate 12 as being separated away from each other in a parallel manner. The support substrate 12 is formed with a liquid supply opening (not illustrated) for supplying the liquid to the element substrates 11A, 11B.

The element substrate 11A is constituted by a silicon substrate having a thickness of 0.725 mm, and formed of six rows of the liquid supply openings (not illustrated) that are through openings in a rectangular-groove-like shape that are liquid flow paths. The element substrate 11B is constituted by a silicon substrate having a thickness of 0.725 mm in the same manner as the element substrate 11A, and formed of one row of the liquid supply openings (not illustrated) that are through openings in a rectangular-groove-like shape that are liquid flow paths. At both sides of the element substrate 11 having the liquid supply opening therebetween, each one row of electrical thermal conversion elements (not illustrated) are formed in alignment along a longitudinal direction of the liquid supply openings. Further, electrical wiring (not illustrated) formed of aluminum for supplying the power to the electrical thermal conversion element is formed. The electrical thermal conversion element and the electrical wiring described above are formed by a film formation technique.

Each row of the electrical thermal conversion elements is aligned in a zigzag, more specifically, the row is arranged slightly shifted from an adjacent row such that they are not aligned in a direction orthogonal to a direction of rows. On a face where the electrical thermal conversion elements are arranged, at both outsides of the electrical thermal conversion elements, electrode units (not illustrated) for supplying the power to the electrical wiring are formed. The electrode units are aligned along the both sides of the electrical thermal conversion elements. On a face of the silicon substrate formed with the electrode units, a structure is formed that includes a liquid flow path wall forming the liquid flow path corresponding to the electrical thermal conversion element and a ceiling portion covering upward the liquid flow path and having an opened ejection opening 16 for ejecting the liquid. This structure is formed of resin material by a photolithography technique, for example.

The ejection opening 16 is provided on a face of the ejection opening of the element substrate 11 to face the electrical thermal conversion element and forms an ejection opening row. As described above, the electrical thermal conversion elements are arranged in a zigzag, and thus the ejection openings 16 facing the electrical thermal conversion elements are also aligned in a zigzag. The liquid supplied from the liquid flow path is ejected via the ejection opening 16 facing each electrical thermal conversion element with pressure of air bubbles generated by heat generation of each electrical thermal conversion element.

The electrical wiring member 14 forms an electrical signal path for applying an electrical signal for ejecting the liquid to the element substrate 11. The electrical wiring member 14 is formed with an opening portion corresponding to each element substrate 11. Near an edge of the opening portion, an electrode terminal to be connected to the electrode unit of the each element substrate 11 is formed. At an end portion of the electrical wiring member 14, an electrical terminal connection unit for electrically connecting with the first electrical circuit substrate 15 is formed. In the electrical wiring member 14, the electrode terminal and the electrical terminal connection unit are connected with each other via a sequence of wiring patterns formed of copper foil.

The electrical connection between the electrical wiring member 14 and the element substrate 11 is performed by, for example, joining the electrode unit of the element substrate 11 with the electrode terminal of the electrical wiring member 14 by a thermal ultrasonic wave pressure-bonding technique. An electrical connection portion between the element substrate 11 and the electrical wiring member 14 is sealed with first sealant and second sealant. With this arrangement, the electrical connection portion is protected from erosion by the liquid and an external shock. The first sealant is used, mainly, to seal a connection portion between the electrode terminal of the electrical wiring member 14 and the electrode of the element substrate 11 from a backside, and to seal an outer circumferential portion of the element substrate 11. The second sealant is used to seal the connection portion from a front side.

The electrical terminal connection portion formed at an end portion of the electrical wiring member 14 is thermally compression bonded using an anisotropic conductive film to electrically connect with the first electrical circuit substrate 15. The first electrical circuit substrate 15 includes an external signal input terminal for receiving the electrical signal. The first electrical circuit substrate 15 is formed with a terminal positioning hole for the positioning and a terminal combining hole for fixing.

The body 21 is one configuration part for guiding the liquid to the support substrate 12 provided with the element substrate 11. The body 21 can be formed by resin molding. The body 21 is provided with a joint portion abutted on a portion of a liquid supply opening of the tank connection unit 200. The joint portion is provided with a filter 30 for catching dust in the liquid supplied from the tank connection unit 200. The filter 30 is formed of suspension of non-woven cloth.

On an outer bottom face of the body 21, a flow-path forming member 22 having an opened liquid feeding opening for supplying the liquid to the support substrate 12 provided with the element substrate 11 is positioned to cause the liquid feeding opening to communicate with the liquid flow path of the body 21 via fluid, and fixed by ultrasonic welding.

The support substrate 12 and the body 21 are pressed and fixed having a joint member therebetween that is provided with a hole at a position corresponding to the liquid supply opening of the support substrate 12 and a hole at the liquid feeding opening of the flow-path forming member 22. The joint member is made of rubber material having a small compression set. The joint member is placed between the support substrate and the flow-path forming member 22 to be pressed therebetween so that possibility of liquid leakage can be reduced at a communication portion between the liquid supply opening and the liquid entry opening.

(Tank Connection Unit, and Tank Fixing Unit)

With reference to FIGS. 4A to 4G, the tank connection unit 200 and the tank fixing unit 300 according to the embodiment of the present invention will be described.

The tank connection unit 200 is fastened to the body 21 of the liquid supply unit 10 with screws. The tank connection unit 200 needs to form seal between the tank connection unit 200 and the tank 500 to securely supply the liquid to the liquid supply unit 10. To supply the liquid, the tank connection unit 200 is provided with a needle 202, and to form the seal, the tank 500 is provided with a seal portion 502.

The tank 500 is inserted into a guide 304 provided at the tank fixing unit 300 toward a direction indicated with an arrow A from a front of the head 1. The needle 202 of the tank connection unit 200 passes through the seal portion 502 of the tank 500 to form the seal along an outer circumferential portion of the needle 202 between the needle 202 and the seal portion 502. With this arrangement, the liquid leakage does not occur, thereby securely supplying the liquid into the head 1.

At an upper portion of the tank connection unit 200 in a vertical direction in the posture of usage, an AB connector 401 is disposed. At both sides of the AB connector 401, a snap fit 402 is disposed. The tank connection unit 200 picks the AB connector 401 with a snap fit 402 at both ends of the opening portion 40 provided at the body 21 of the liquid supply unit 10, and is positioned using a reactive force of the AB connector 401.

Figure 4A:
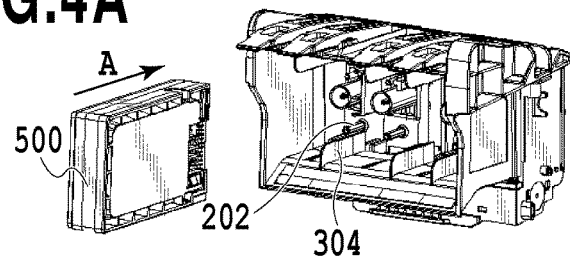
FIGS. 4A to 4G are perspective views illustrating the head and the tank according to the present invention.
Figure 4B:
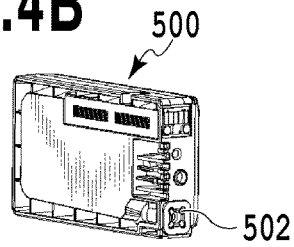
Figure 4C:
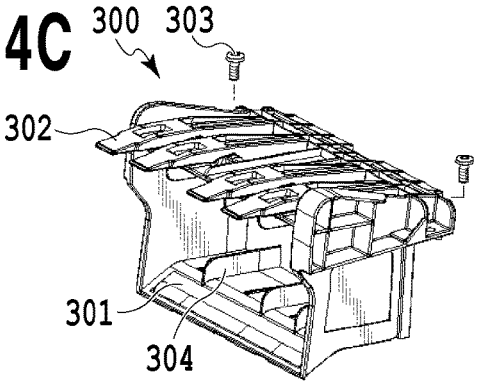
Figure 4D:
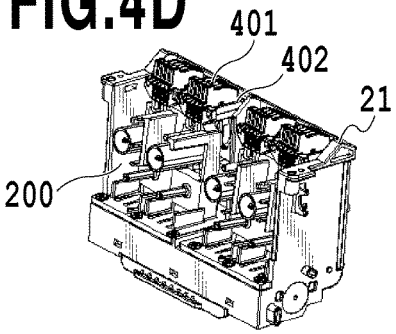
Figure 4E:
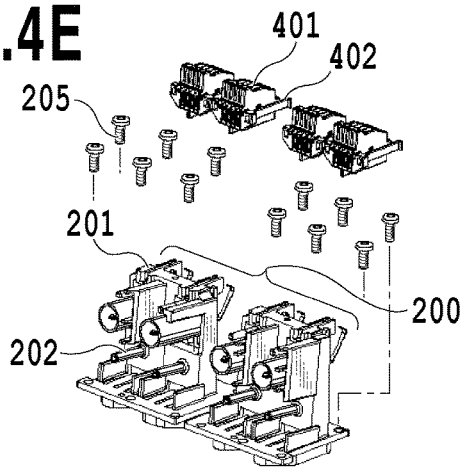
Figure 4F:
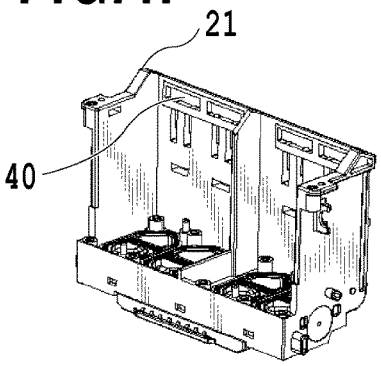
Figure 4G:
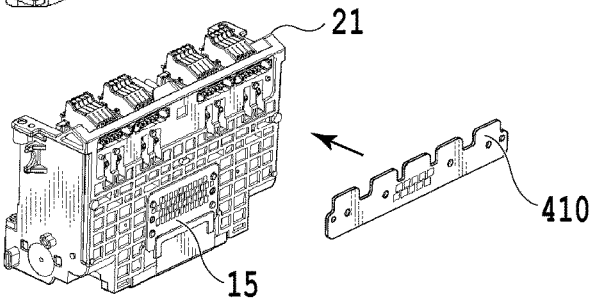

Four AB connectors 401 are provided for each tank 500, and connected to a second electrical circuit substrate 410 swaged by the body 21 of the liquid supply unit 10. According to the present embodiment, as illustrated in FIG. 4G, the electrical circuit substrate is separated into the first electrical circuit substrate 15 and the second electrical circuit substrate 410. However, according to the present invention, the first electrical circuit substrate 15 and the second electrical circuit substrate 410 may be combined into one.

The tank fixing unit 300 includes a lever 302 to be engaged with the tank 500 and a cover 301 holding the lever. The cover 301 is fastened to the body 21 of the liquid supply unit 10 with screws 303. The cover 301 is provided with a guide 304 to securely guide the tank 500 in the case where the tank 500 is mounted. According to the embodiment illustrated in FIGS. 4A, 4C, each guide 304 is separated into two members of an upper side and a lower side in the vertical direction in the posture of usage, however, the upper side and the lower side may be connected with each other.

(Mounting Liquid Ejection Head to Carriage)

FIGS. 5A to 5D and FIGS. 6A to 6D are perspective views illustrating a state where the head 1 according to the embodiment of the present invention is mounted to the carriage 102 of the liquid ejection apparatus 100. With reference to FIGS. 5A to 5D and FIGS. 6A to 6D, a configuration for determining a position of mounting the head 1 in the case where the head 1 is mounted to the carriage 102 that is a mount unit of the liquid ejection head in the liquid ejection apparatus 100 will be described.

Figure 5B:
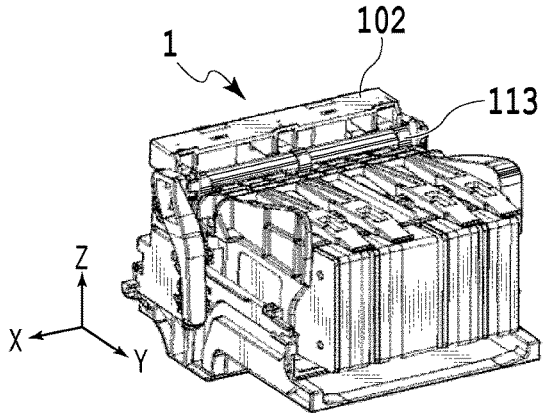

FIG. 5A is a perspective view schematically illustrating the liquid ejection apparatus 100 according to the embodiment of the present invention. FIG. 5B is a partial perspective view illustrating the head 1 mounted to the carriage 102 of the liquid ejection apparatus 100 together with the carriage 102. As illustrated in FIGS. 5A, 5B, the head 1 is mounted to the carriage 102 scanning in an X direction along the guide rail 101 of the liquid ejection apparatus 100.

Figure 5C:
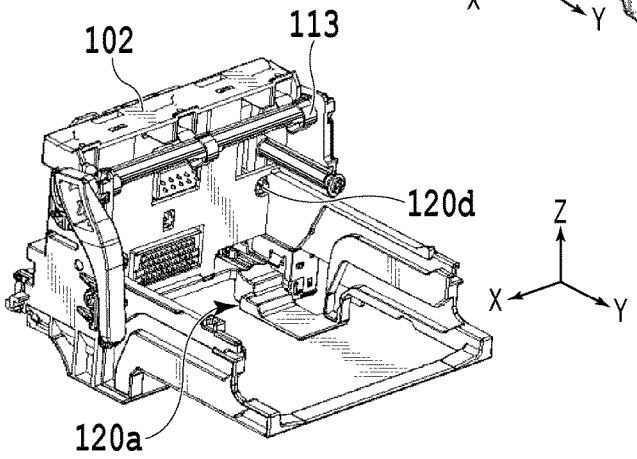
Figure 5D:
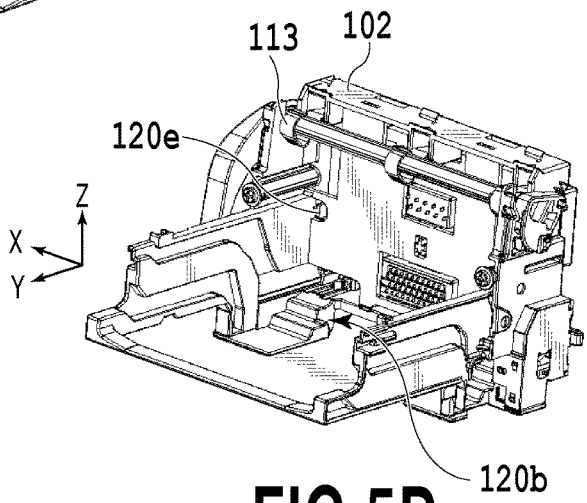

FIGS. 5C, 5D are perspective views illustrating the carriage 102 without the head 1 mounted, illustrating a face at a side of mounting the head 1 that are viewed from a different orientation.

As illustrated in FIGS. 5C, 5D, to determine a position of mounting the head 1 in a Y direction, the carriage 102 includes four positioning portions 120 at a carriage side. More specifically, the carriage 102 includes first positioning portions 120*a*, 120*b* provided on an upper face of the bottom, and second positioning portions 120*d*, 120*e* provided on an inside face crossing the Y direction.

Figure 6A:
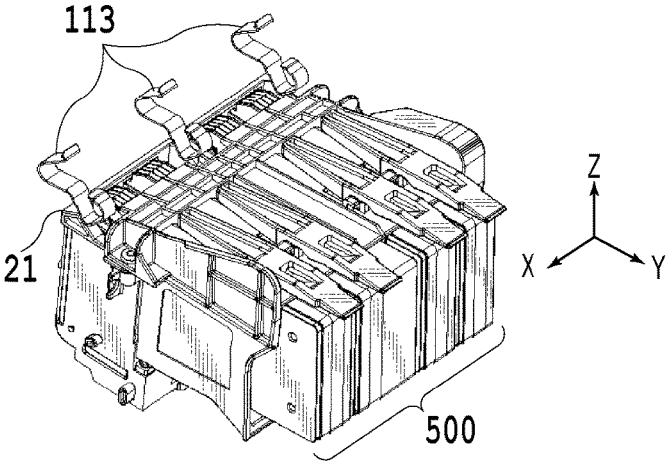
FIG. 6A illustrates a pressure-receiving portion of the head according to the present invention to be pressed by a head set lever of the carriage.
Figure 6B:
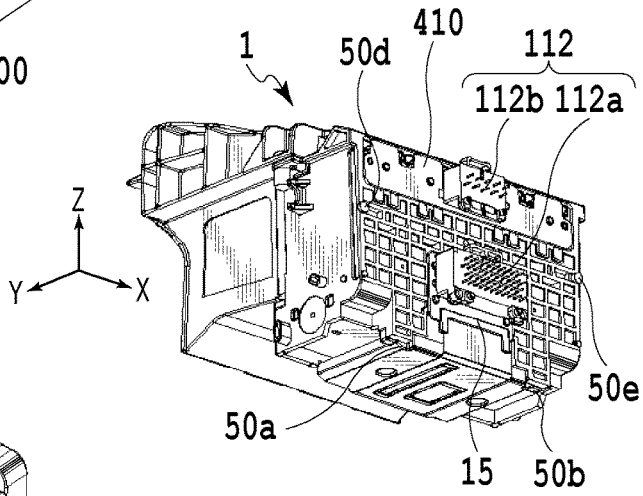
FIG. 6B illustrates an electrical connector of the head according to the present invention to be connected with a main body of the liquid ejection apparatus.
Figure 6C:
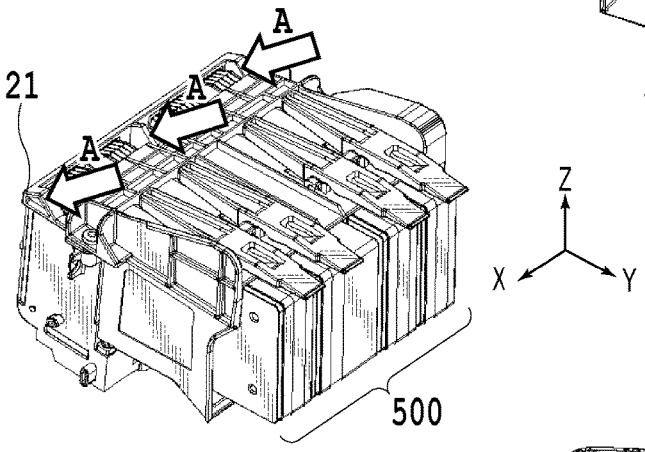
FIGS. 6C and 6D illustrate load and a reaction force acting on the head according to the present invention.
Figure 6D:
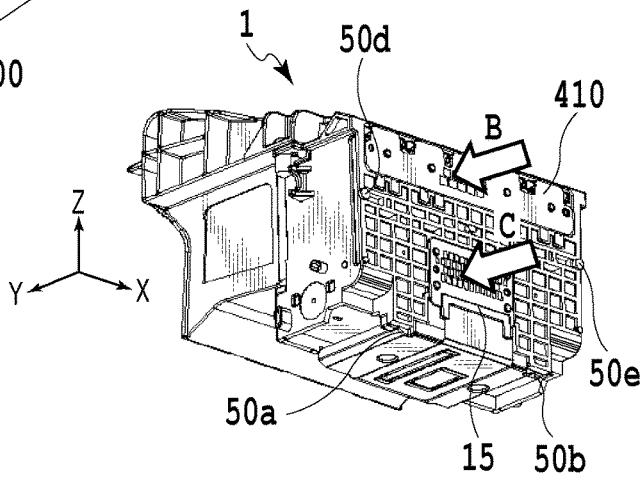

FIGS. 6B, 6D are perspective views of the head 1 viewed from a face thereof at a side of being mounted to the carriage 102. With reference to FIG. 6D, the head 1 includes four positioning portions 50 at a head side corresponding to the positioning portions 120 at the carriage side, more specifically, first positioning portions 50*a*, 50*b* provided on the support substrate, and second positioning portions 50*d*, 50*e* provided on a backside of the body.

The first positioning portions include an abutment face for abutting on the carriage 102 to restrict a shift of the head 1 with respect to the carriage in the Y direction, in the case where the head 1 mounted to the carriage 102 receives a force in the Y direction. The second positioning portions include an abutment face for abutting on the carriage 102 to restrict a shift of the head 1 with respect to the carriage in a −Y direction, in the case where the head 1 mounted to the carriage 102 receives a force in the −Y direction. The second positioning portions 50*d*, 50*e* at a side of the head 1 are protrusions protruding from the backside of the body 21.

With reference to FIG. 6B, the head 1 is mounted to the carriage 102 via an electrical connector 112 electrically connecting the head 1 with the main body of the liquid ejection apparatus 100. More specifically, as the electrical connector 112, the first electrical connector 112*a* and the second electrical connector 112*b* are mounted respectively to the first electrical circuit substrate 15 and the second electrical circuit substrate 410 to form the electrical contact point with the carriage 102.

With reference to FIGS. 5A to 5D and FIGS. 6A to 6B, the force to be applied to the head 1 mounted to the carriage 102 will be described. FIGS. 6A, 6C are perspective views of the head 1 viewed from a side of mounting the tank 500. In FIGS. 5A to 5D and FIGS. 6A to 6D, a direction along a direction indicated with the arrow X (X direction) is a scanning direction of the carriage 102, a direction indicated with the arrow Y (Y direction) is a conveyance direction of a medium, and a direction (−Z direction) opposite to an orientation along a direction (Z direction) indicated with the arrow Z is a direction for ejecting the liquid.

With reference to FIG. 6A, the carriage 102 is provided with a head set lever 113 of a flat-spring type side by side at three places in the X direction. The head set lever 113 abuts on the pressure-receiving portion provided at the both sides of the body 21 of the head 1 in the X direction (i.e., direction along an intersection line between the back side and the bottom face of the body 21) and at an intermediate portion between the both sides so as to fix mounting of the head 1 to the carriage 102.

With reference to FIG. 6C, the head 1 receives load A by the head set lever 113 in a state where the head 1 is mounted to the carriage 102. The load A acts to press the head 1 onto the carriage 102. In order to apply the load A as described above, it is preferable that the head set lever 113 should be provided upward with respect to the body 21 of the head 1 mounted to the carriage 102 in the posture of usage.

A force of the load A can be analyzed into components in the −Y direction opposite to the orientation of the Y direction that is a medium conveyance direction, and the −Z direction that is a liquid ejection direction. With the force of the component in the −Y direction of the load A, the second positioning portions 50*d*, 50*e* at the head side provided on the backside of the body 21 of the head 1 respectively come into contact with the second positioning portions 120*d*, 120*e* at the carriage side provided on an inner wall of the carriage 102 facing the backside of the body 21. In other words, a face facing an upstream side of the second positioning portions 50*d*, 50*e* at the head side in the Y direction and a face facing a downstream side of the second positioning portions 120*d*, 120*e* at the carriage side in the Y direction are abutted on each other respectively.

Further, the head 1 receives a reaction force B from the second electrical connector 112*b* and a reaction force C from the first electrical connector 112*a* in the Y direction in a state where the head 1 is mounted to the carriage 102. With the reaction force C, the first positioning portions 50*a*, 50*b* at the head side respectively come into contact with the first positioning portions 120*a*, 120*b* at the carriage side. In other words, a face facing the downstream side of the first positioning portions 50*a*, 50*b* at the head side in the Y direction and a face facing the upstream side of the first positioning portions 120*a*, 120*b* at the carriage side in the Y direction are abutted on each other respectively.

As described above, the positioning portions 50, 120 corresponding to the head 1 and the carriage 102 come into contact with each other to determine mounting positions of the head 1 in the Y direction with respect to the carriage 102, thereby fixing the head 1 to the carriage 102.

In order to obtain favorable accuracy of positioning and stability of mounting in the case where the position of the mounting in the Y direction is determined, it is preferable that generation of a force for rotating the head 1 about an axis along the Z direction should be restricted. Therefore, the first positioning portions are preferably provided at both outsides of an arrangement region of the element substrate in the X direction. Further, the second positioning portions are preferably provided at both ends of an arrangement region of the tank 500 in the X direction, and more preferably at both sides of the body 21 in a width direction.

Herein, the first positioning portions 50*a*, 50*b* provided on the support substrate 12 of the head 1 function as the positioning portions in the Y direction also, and further a reference face in the case where the support substrate 12 and the element substrate 11 are bonded with each other. The positioning portions of the head 1 and the carriage 102 function as the reference face in the case where the support substrate 12 and the element substrate 11 are bonded with each other, so that the element substrate 11 can be accurately positioned with respect to the carriage 102.

(Characteristics of Present Invention)

Figure 7:
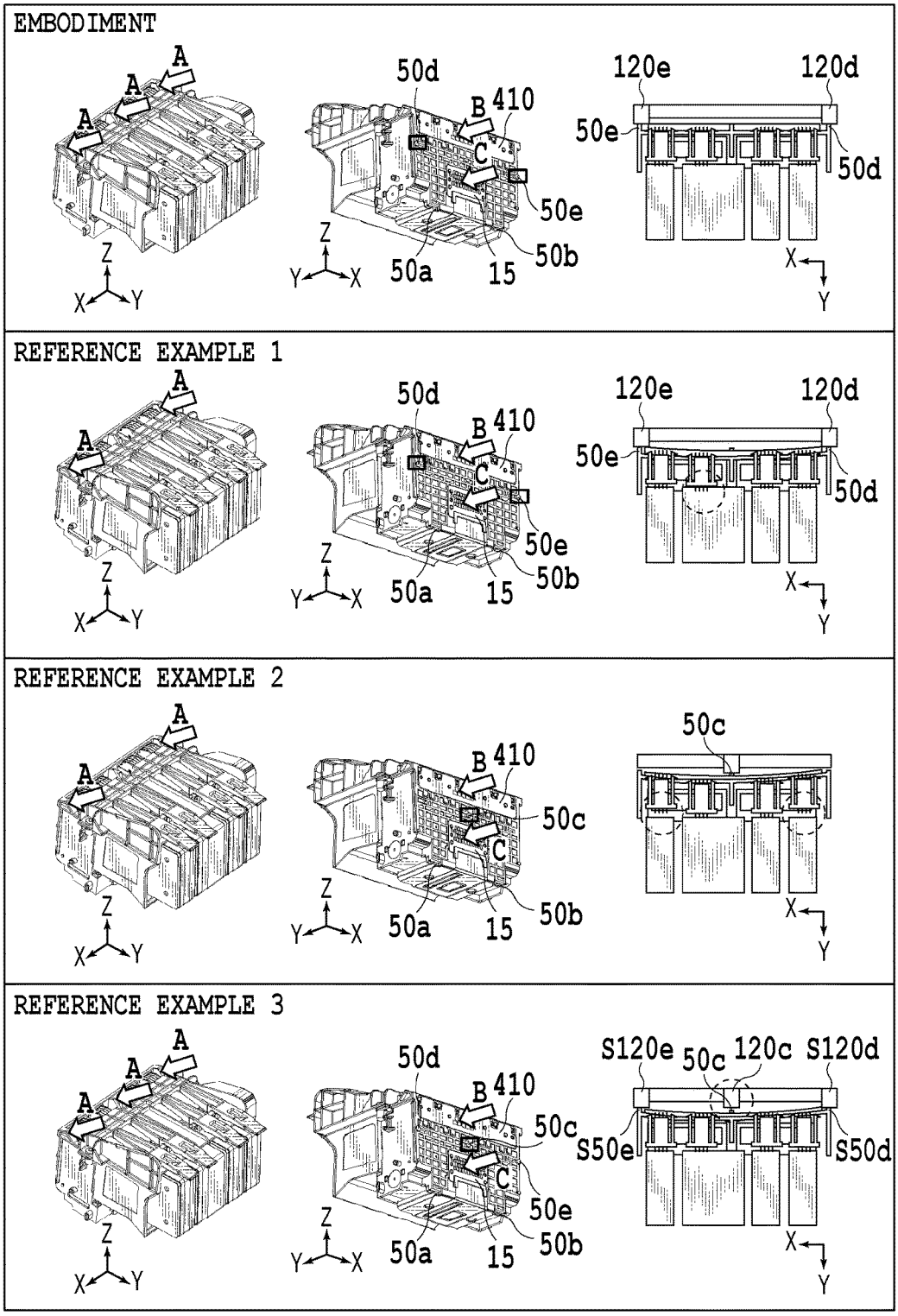
FIG. 7 illustrates a characteristic configuration of the head according to the present invention.

With reference to FIG. 7, while comparing the embodiment according to the present invention with a reference example, the characteristics of the present invention will be described. Same configuration elements in the embodiment are indicated using the same reference symbol, and the description will not be repeated.

As illustrated in FIG. 7, a diagram at a left side of three diagrams illustrating each embodiment is a perspective view of the head 1 viewed in a direction for mounting the tank 500. The arrow A indicates the load (load A) applied to the head 1 via the head set lever 113. As illustrated in a central diagram of the three diagrams illustrating each embodiment, an arrow B and an arrow C indicate reactive forces (reactive forces B, C) from the electrical connector 112 against the head 1. Further, portions surrounded by a square of a bold solid line indicate the positioning portion 50 at the backside of the body 21 of the head 1. A drawing at a right side of the three diagrams illustrating each embodiment illustrates a top face of the head 1 and indicates a state of deformation of the backside of the body 21.

In the embodiments and reference examples 1 to 3, the first positioning portions 50*a*, 50*b* at two points provided on the support substrate 12 of the head 1 are defined to have the same position and shape. Further, in the embodiments illustrated in FIG. 7 and reference examples 1 to 3, material of the body 21 is defined to include resin including polyphenylene sulfide (PPS) and polyethylene (PE), and no glass filler.

Configuration of Embodiment

Configuration of Four Points Positioning+Three Points Pressing

According to the embodiment of the present invention, four positioning portions 50 in total determine the position of the head 1 in the Y direction. More specifically the first positioning portions 50*a*, 50*b* are each provided at two points of the support substrate 12, and the second positioning portions 50*d*, 50*e* are each provided at two points of the body 21. The body 21 is mounted with the second electrical circuit substrate 410 more upward than a virtual straight line connecting the second positioning portion 50*d* with the second positioning portion 50*e* in the posture of usage, in other words, at an opposite side of the element substrate 11 with respect to the straight line in the Z direction. In other words, the second electrical circuit substrate 410 is positioned closer to a side of the pressure-receiving portion for receiving the load A via the head set lever 113 than the virtual straight line connecting the second positioning portion 50*d* with the second positioning portion 50*e*.

Herein, it is supposed that the second positioning portions 50*d*, 50*e* of the body 21 are to be positioned more upward than the position indicated in the diagrams, for example, more upward than a pad (copper foil for soldering) of the second electrical circuit substrate. In this case, a distance between the second positioning portions and a point of effort of the load via the headset lever 113 in the Z direction becomes shorter to reduce a rotation moment applied to the head 1. In the case where the rotation moment becomes smaller, an abutment force in which the first positioning portions 50*a*, 50*b* provided on the support substrate 12 come into contact with the carriage 102 becomes also smaller. In the case where the abutment force is small, mounting stability of the head 1 to the carriage 102 may not be appropriately obtained. Thus, in order to set a sufficient distance in the Z direction to obtain an appropriate abutment force in the Y direction, the second positioning portions 50*d*, 50*e* are provided more downward than the second electrical circuit substrate 410 on the body 21.

According to the embodiment, three portions (pressure-receiving portion) where the head 1 is pressed by the head set lever 113 (pressing portion) of the carriage 102 are provided at the both sides of the body 21 and the intermediate portion therebetween in the X direction. The head set lever 113 is abutted on the head 1 such that the head 1 is pressed against the carriage 102.

Figure 8A:
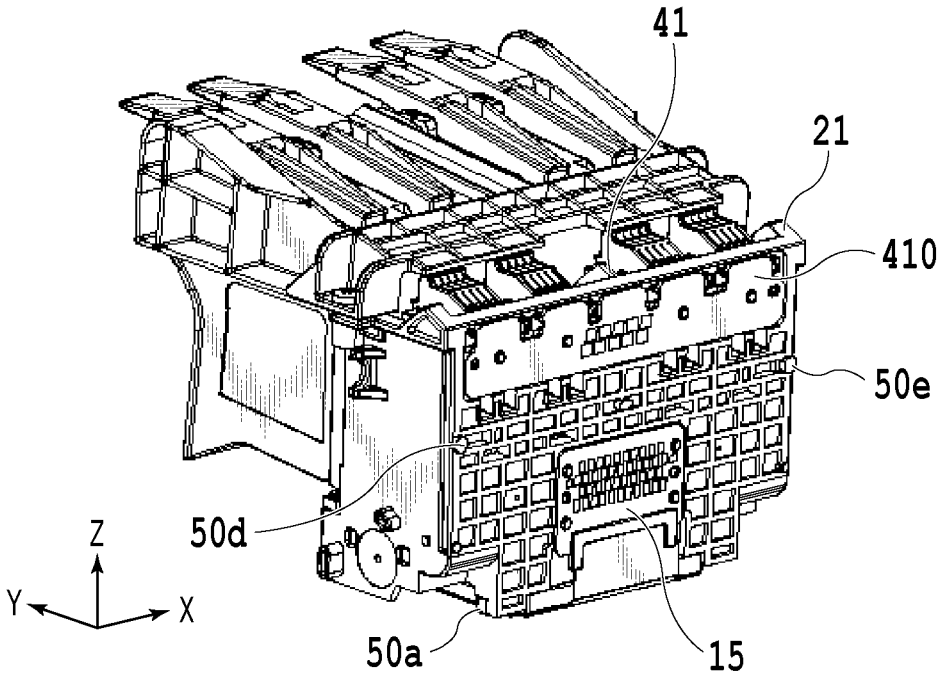
FIGS. 8A and 8B illustrate the head according to an embodiment of the present invention.
Figure 8B:
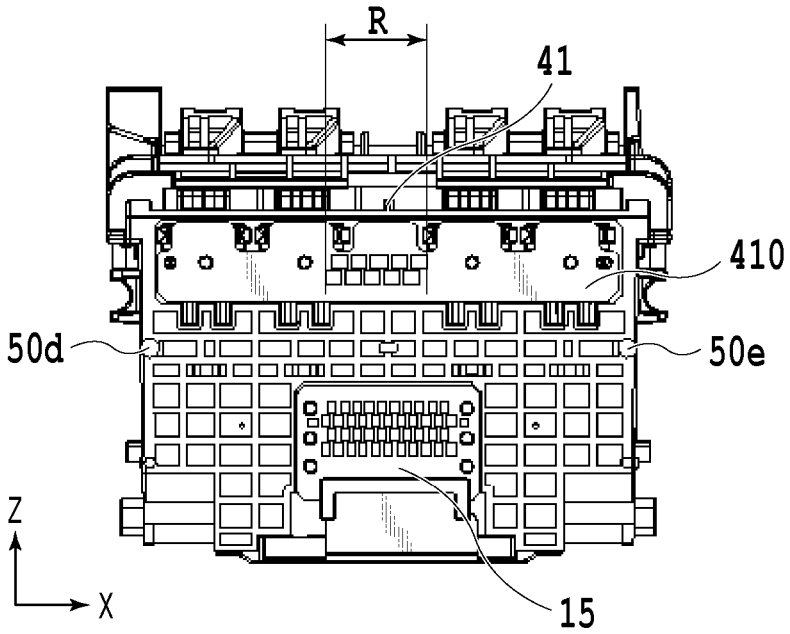

FIG. 8A is a perspective view of the head 1 viewed from the backside. FIG. 8B is a backside view of the head 1. As described above, in the case where the head 1 is mounted to the carriage 102, the first electrical connector 112*a* is mounted to the first electrical circuit substrate 15, and the second electrical connector 112*b* is mounted to the second electrical circuit substrate 410 to configure the electrical contact point. FIG. 8B illustrates an area where the second electrical circuit substrate 410 and the second electrical connector 112*b* configure the electrical contact point in the X direction as an electrical contact region R.

According to the embodiment, the pressure-receiving portion (hereinafter, simply referred to as "intermediate portion") 41 at the intermediate portion of the three pressure-receiving portions 41 of the body 21 in the X direction is provided in the electrical contact region R in the X direction. The intermediate portion is preferably arranged at a center of the electrical contact region R in the X direction. As long as within the electrical contact region R, the intermediate portion may not necessarily be arranged at a position at a center of the body 21 in the X direction, or a position away from an equal distance from the pressure-receiving portions 41 at the both sides in the X direction, and it may be arranged with some shift from the positions described above. The present embodiment includes one intermediate portion, however, the present invention may not be limited to the one intermediate portion, but may include a plurality of intermediate portions.

Figure 9A:
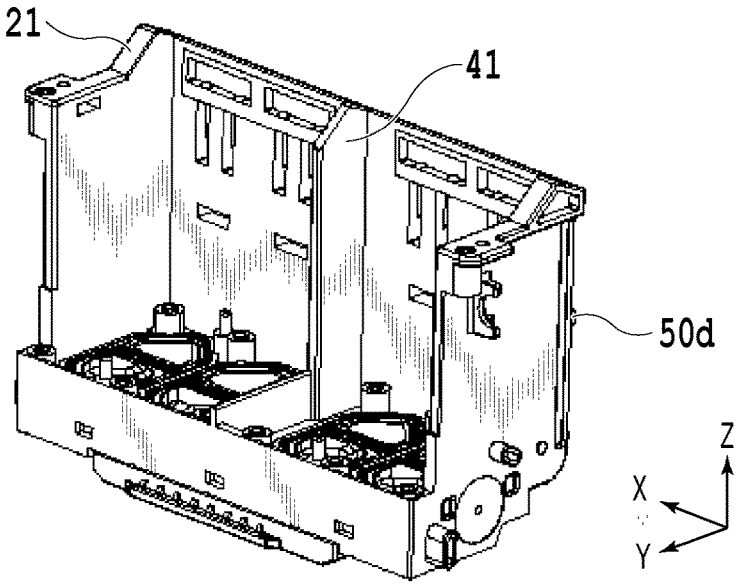
FIGS. 9A to 9C illustrate a liquid supply unit of the head according to the embodiment of the present invention.
Figure 9B:
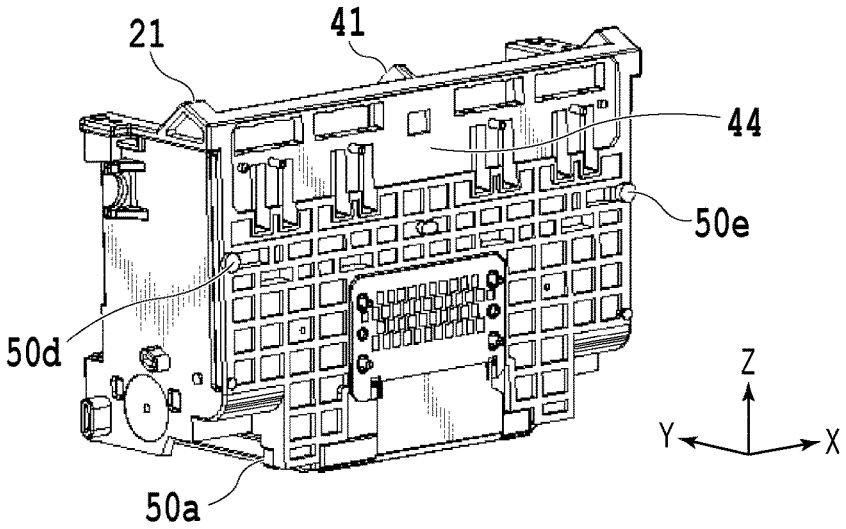
Figure 9C:
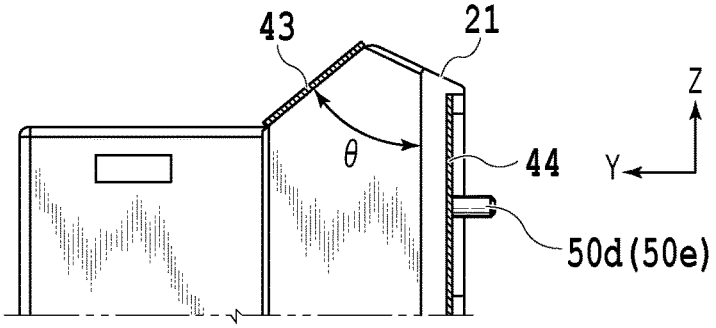

FIGS. 9A to 9C illustrate the liquid supply unit 10 according to the present embodiment. FIG. 9A is a perspective view viewed from an inside of the body 21. FIG. 9B is a perspective view viewed from the backside of the body 21. FIG. 9C is a schematic view of a side face of the body 21. As illustrated in FIG. 9C, the pressure-receiving portion 41 is a portion in a sloped shape having an angle of θ that is 0 degrees or more and less than 90 degrees with a face (backside) 44 mounted with the second electrical circuit substrate 410 of the body 21.

With such angle setting, at the intermediate portion, the force of the components derived from the load A by the head set lever 113 in the Y direction can be offset with the reaction force B derived from the electrical connector in an orientation and a size. Therefore, the backside portion of the body 21 can hold a state of a shape in a straight line substantially without any deformation.

Reference Example 1

Configuration of Four Points Positioning+Two Points Pressing

The head 1 of the reference example 1 is different from the embodiment in that only two portions (pressure-receiving portions) where the head 1 is pressed by the head set lever 113 (pressing member) of the carriage 102 are provided at the both sides of the body 21 in the X direction.

The number, the positions, the configuration of the positioning portions are the same as the embodiment, and the head 1 can be positioned to the carriage 120 with high accuracy.

Herein, in the case where the head 1 is mounted in the liquid ejection apparatus, since the reaction force B and the reaction force C act on the body 21 from the electrical connector 112 that is the electrical connection portion with the main body of the liquid ejection apparatus, the backside portion of the body 21 is easily, greatly deformed in the Y direction that is the orientation of the reaction forces. However, unlike the embodiment, the head 1 of the reference example 1 does not include the pressure-receiving portion 41 for receiving the force in the −Y direction at the intermediate portion. Therefore, naturally, this deformation is not corrected.

In the case where the backside portion of the body 21 is deformed in the Y direction, the AB connector 401 projects in the Y direction. Therefore, in the case where a user mounts the tank to the head 1, excess load in a direction (−Y direction) for correcting the deformed wall at the backside portion of the body 21 is necessary, and thus a force necessary for an operation in the case where the user mounts the tank is increased. Further, in the case where the backside portion of the body 21 is greatly deformed in the Y direction, securing the electrical contact point between the second electrical circuit substrate 410 and the second electrical connector 112*b* can be difficult.

Reference Example 2

Configuration of Three Points Positioning+Two Points Pressing

The difference of the reference example 2 from the embodiment is the number and the position of the positioning portions provided on the backside portion of the body 21 in addition to the number and the positions of the pressure-receiving portions. Since the number and the positions of the pressure-receiving portions are the same as the reference example 1, its configuration and effects will not be described herein.

According to the reference example 2, one positioning portion 50*c* is provided at a center of the body 21 in the X direction, and the positioning portions 50*d*, 50*e* at the both sides thereof are not provided. The positioning portion 50*c* is a protrusion protruding from the backside of the body 21. By the force including the components of the load A in the −Y direction added to the pressure-receiving portion 41 at the both sides of the body 21 in the X direction from the head set lever 113, the both sides of the body 21 are greatly deformed to a side of the −Y direction having the positioning portion 50*c* as an original point. Therefore, securing the electrical contact point between the AB connector and the tanks positioned at the both sides in the X direction of the tanks 500 mounted to the head 1 can be difficult.

Reference Example 3

Configuration of Three Points Positioning+Three Points Pressing+Restricting Deformation The difference of the reference example 3 from the embodiment is that, in place of apart of the positioning portion provided on the backside portion of the body 21, a deformation-restricting portion is provided. More specifically, in place of the positioning portions 50*d*, 50*e*, deformation-restricting portions S50*d*, S50*e* for restricting the deformation of the head 1 are provided at the both sides of the body 21 in the X direction. Further, at facing carriage sides, their corresponding deformation-restricting portions S120*d*, S120*e* are provided.

Herein, the deformation-restricting portions at the head side and the carriage side are provided to be abutted on each other, in the case where the amount of the deformation becomes beyond a predetermined amount of deformation, so as to restrict the deformation by the amount beyond the predetermined amount. The deformation-restricting portions S50*d*, S50*e* are not abutted on the deformation-restricting portions S120*d*, S120*e* provided at the facing carriage sides in a state where the head 1 is not deformed, but fine clearance (e.g., 0.1 to 0.25 mm) is secured. In the case where the head 1 has no deformation or has small deformation, the head 1 has a dimensional relationship in which only the positioning portion 50*c* at the central portion of the body 21 in the X direction is abutted on the carriage 102.

However, since the body 21 according to the present embodiment is made of material having low rigidity, due to the load A to the both sides, the backside portion of the body 21 is deformed. In a process of the deformation, the deformation-restricting portion at the head side comes into contact with the deformation-restricting portion at the carriage side; rather, the positioning portion 50*c* at the central portion at the head side is separated to be forced away from the positioning portion 120*c* at the corresponding carriage side. In other words, according to the configuration of the reference example 3, it may be difficult to determine the position of the head 1 at the predetermined position with respect to the carriage 102.

Effects of the Present Invention

By comparison between the above-described embodiments and the reference examples 1 to 3, the effects of the present invention will be described.

According to the configuration of the present invention, the deformation of the backside portion of the body 21 mounted with the second electrical circuit substrate 410 is restricted. Therefore, a problem of a contact state of the electrical contact point between the second electrical circuit substrate and the electrical connector to the main body of the liquid ejection apparatus as described in the reference example 1, and a problem of the contact state of the electrical contact point between the AB connector and the pad of the tank as described in the reference example 2 can be avoided.

According to the configuration of the present invention, the deformation of the backside portion of the body is restricted so that a phenomenon where the AB connector mounted in the body 21 becomes protruded to the front as described in the reference example 1 does not occur. Therefore, in the case where the tank 500 is mounted to the head 1, the backside portion of the body does not need to be corrected beyond the AB connector. In other words, the tank can be mounted without difficulties.

Further, according to the configuration of the present invention, as to the positioning of the head, a phenomenon in which the positioning portion of the body flows with respect to the carriage 102 as described in the reference example 3 does not occur. By the load A applied to the body 21, the positioning portion at the body side can securely come into contact with the positioning portion at the carriage side.

As described above, according to the configuration of the present invention, at any arrangement of the electrical contact points, in the liquid ejection head, both the positioning with respect to the liquid ejection apparatus with high accuracy and reliability of the electrical contact can be realized. Further, according to the present invention, a favorable mounting property of the tank can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170348 filed Aug. 25, 2014, which is hereby incorporated by reference herein in its entirety.

What is claimed is:

1. A liquid ejection head comprising:

an element substrate configured to eject liquid according to an electrical signal;

an electrical circuit substrate configured to send the electrical signal to the element substrate; and a body including the element substrate on a first face and the electrical circuit substrate on a second face crossing the first face, wherein the liquid ejection head is mounted in a mount unit of a liquid ejection apparatus via an electrical connector including an electrical contact point with the electrical circuit substrate, wherein the body includes pressure-receiving portions for, in a case where the body is mounted to the mount unit, receiving a force including a component in a first direction in which the second face is pressed against the mount unit and a component in a second direction in which the element substrate ejects liquid, wherein the liquid ejection head includes first positioning portions provided on the first face and second positioning portions provided on the second face, that determine a position of the body with respect to the mount unit in the first direction by abutting the mount unit, wherein the first positioning portions are arranged at both outsides of an arrangement region of the element substrate in a direction along an intersection line between the first face and the second face, wherein the second positioning portions are arranged at both end portions of the second face in a direction along the intersection line, and wherein the pressure-receiving portions are arranged at both end portions of the body and at an intermediate portion between both end portions in the direction along the intersection line in such a manner that one of the pressure-receiving portions that is arranged at the intermediate portion is located between the pressure-receiving portions arranged at both end portions.

2. The liquid ejection head according to claim 1, wherein the intermediate portion is positioned within an area of a region where the liquid ejection head receives a reaction force from the electrical connector in the case where the liquid ejection head is mounted to the mount unit in the direction along the intersection line.

3. The liquid ejection head according to claim 1, wherein at least a part of the electrical circuit substrate is arranged at a side away from the element substrate with respect to a virtual straight line connecting the second positioning portions with each other in the second direction.

4. The liquid ejection head according to claim 1, further comprising a plurality of the electrical circuit substrates.

5. The liquid ejection head according to claim 1, wherein each of the pressure-receiving portions is a part in a sloped shape having an angle of 0 degrees or more and less than 90 degrees with respect to the second face.

6. The liquid ejection head according to claim 1, wherein the element substrate is disposed on the first face of the body via a support substrate supporting the element substrate and being supported by the body, and wherein the first positioning portions are provided on the support substrate.

7. The liquid ejection head according to claim 1, wherein the body removably mounts a liquid housing container for storing liquid to be supplied to the element substrate in the first direction, and includes a flow path for, in the case where the liquid housing container is mounted, causing the liquid housing container to communicate with the element substrate via fluid.

8. The liquid ejection head according to claim 1, wherein the first direction is a direction in which the electrical circuit substrate is pressed against the electrical connector.

9. The liquid ejection head according to claim 1, wherein the body includes no glass filler and is formed of resin including polyphenylene sulfide and polyethylene.

10. A liquid ejection apparatus comprising a mount unit to which a liquid ejection head is mounted, the liquid ejection head comprising:

an element substrate configured to eject liquid according to an electrical signal;

an electrical circuit substrate configured to send the electrical signal to the element substrate; and a body including the element substrate on a first face and the electrical circuit substrate on a second face crossing the first face, wherein the liquid ejection head is mounted in the mount unit of the liquid ejection apparatus via an electrical connector including an electrical contact point with the electrical circuit substrate, wherein the body includes pressure-receiving portions for, in the case where the body is mounted to the mount unit, receiving a force including a component in a first direction in which the second face is pressed against the mount unit and a component in a second direction in which the element substrate ejects liquid, wherein the liquid ejection head includes first positioning portions provided on the first face and second positioning portions provided on the second face that determine a position of the body with respect to the mount unit in the first direction by abutting the mount unit, wherein the first positioning portions are arranged at both outsides of an arrangement region of the element substrate in a direction along an intersection line between the first face and the second face, wherein the second positioning portions are arranged at both end portions of the second face in a direction along the intersection line, wherein the pressure-receiving portions are arranged at both end portions of the body and at an intermediate portion between both end portions in the direction along the intersection line in such a manner that one of the pressure-receiving portions that is arranged at the intermediate portion is located between the pressure-receiving portions arranged at both end portions, and wherein the mount unit includes pressing portions for, in the case where the mount unit mounts the liquid ejection head, applying the force to the liquid ejection head, the force including the component in the first direction that presses the second face against the mount unit and the component in the second direction in which the element substrate ejects liquid, and an electrical connection unit for sending the electrical signal to the electrical circuit substrate via an electrical connector.

11. The liquid ejection apparatus according to claim 10, wherein the mount unit is a carriage scanning in a third direction which intersects with the first direction and the second direction.

* * * * *